US012220008B2

(12) United States Patent
Mazzarolo et al.

(10) Patent No.: US 12,220,008 B2
(45) Date of Patent: Feb. 11, 2025

(54) WEARABLE PROTECTION DEVICE

(71) Applicant: ALPINESTARS RESEARCH S.P.A., Maser (IT)

(72) Inventors: Giovanni Mazzarolo, Coste di Maser (IT); Lorenzo Nardo, Ponzano Veneto (IT); Filippo Galassini, Palazzolo dello Stella (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 70 days.

(21) Appl. No.: 18/003,097

(22) PCT Filed: Jun. 23, 2021

(86) PCT No.: PCT/EP2021/067142
§ 371 (c)(1),
(2) Date: Dec. 22, 2022

(87) PCT Pub. No.: WO2021/260002
PCT Pub. Date: Dec. 30, 2021

(65) Prior Publication Data

US 2023/0240388 A1 Aug. 3, 2023

(30) Foreign Application Priority Data

Jun. 26, 2020 (IT) ..... 102020000015454

(51) Int. Cl.
*A41D 13/018* (2006.01)
*A41D 13/00* (2006.01)

(52) U.S. Cl.
CPC ..... *A41D 13/018* (2013.01)

(58) Field of Classification Search
CPC ..... A41D 13/018
See application file for complete search history.

(56) References Cited

U.S. PATENT DOCUMENTS 4,397,046 A * 8/1983 Steiner ..... A41D 13/018 2/908
6,270,386 B1 * 8/2001 Visocekas ..... A63B 29/021 441/89

(Continued)

FOREIGN PATENT DOCUMENTS

CN 209359724 U 9/2019
CN 210330003 U 4/2020

(Continued)

OTHER PUBLICATIONS

PCT International Search Report and Written Opinion dated Sep. 23, 2021 for Intl. App. No. PCT/EP2021/067142, from which the instant application is based, 10 pages.

*Primary Examiner* — Robert H Muromoto, Jr.
(74) *Attorney, Agent, or Firm* — Fredrikson & Byron, P.A.

(57) ABSTRACT

A wearable protection device including at least one inflatable member for moving between a rest configuration in a deflated status and an active configuration in an inflated status. The at least one inflatable member including at least one elongated portion which departs from a connecting body and the at least one elongated portion being in fluid communication with the connecting body. At least one part of the at least one elongated portion is enwrapped by at least one constraint which is designed to limit the expansion of said at least one elongated portion when the inflatable member moves in the active configuration.

21 Claims, 5 Drawing Sheets

(56) References Cited

U.S. PATENT DOCUMENTS

| | | | | |
|---|---|---|---|---|
| 8,910,319 | B2 * | 12/2014 | Dainese | A41D 13/0155 2/456 |
| 9,332,794 | B2 * | 5/2016 | Mazzarolo | A41D 13/0512 |
| 9,555,311 | B1 * | 1/2017 | Mustafa | A41D 13/0005 |
| 11,219,262 | B2 * | 1/2022 | Park | A41D 13/018 |
| 11,452,322 | B2 * | 9/2022 | Elvira | A41D 13/055 |
| 2012/0032422 | A1 * | 2/2012 | Dainese | B62J 27/20 280/728.1 |
| 2012/0073035 | A1 * | 3/2012 | Mazzarolo | A41D 13/018 2/463 |
| 2013/0276213 | A1 * | 10/2013 | Olsson | A42B 3/122 2/468 |
| 2018/0325194 | A1 * | 11/2018 | Elvira | A61B 17/1325 |
| 2021/0045486 | A1 * | 2/2021 | Park | G08B 25/016 |
| 2021/0329986 | A1 * | 10/2021 | Mazzarolo | A41D 31/185 |
| 2022/0361605 | A1 * | 11/2022 | Elvira | A61F 5/32 |
| 2023/0240388 | A1 * | 8/2023 | Mazzarolo | A41D 13/018 2/463 |

FOREIGN PATENT DOCUMENTS

| | | | |
|---|---|---|---|
| CN | 111671174 | A | 9/2020 |
| EP | 3498117 | A1 | 6/2019 |
| EP | 4072364 | A1 | 10/2022 |
| WO | 2011148354 | A1 | 12/2011 |

* cited by examiner

WEARABLE PROTECTION DEVICE

RELATED APPLICATIONS

This application is a 35 U.S.C. 371 national stage filing from International Application No. PCT/EP2021/067142, filed Jun. 23, 2021, which claims priority to Italian Application No. 102020000015454, filed Jun. 26, 2020, the teachings of which are incorporated herein by reference.

FILED OF THE INVENTION

The present invention relates, in general, to the technical field of wearable protection devices. In particular, the present invention relates to a wearable protection device provided with an inflatable member suitable for being inflated in case of danger, so as to offer an additional protection to the user against impacts and/or falls. Such wearable protection devices are also called "wearable airbag devices" and are suitable for being worn during different types of activities, like riding motorcycle, cycling, skiing, walking or during industrial working activities and the like.

BACKGROUND

Typically, a wearable airbag device consists of a wearable item, like for example a jacket, a suit, a vest, a gilet, a belt. The wearable item generally contains: an inflatable bag, inflation means of the bag and a system to activate the inflation means. The activation system can be electronic, on the basis of data detected by sensors applied on the garment or on the vehicle used in combination with the wearable airbag device, or mechanical.

Current inflatable bags are made of a woven fabric or membranes with low elasticity, so as to be able to sustain the force exerted by the inflating fluid during inflation.

In the deflated status, due to its low elasticity, the inflatable bag has a shape similar to that of the body part to be covered/protected once the bag is inflated, making the wearable airbag device quite rigid.

Moreover, even if the inflatable bag is inserted inside a casing made of a breathable fabric, unavoidably the structure of the bag does not allow air to pass through, causing an overheating and a reduced perspiration of the user's body.

Furthermore, even if the inflatable bags are manufactured with materials having a low elasticity, once inflated, they tend to assume a spherical shape, like a balloon.

Such a balloon shape reduces the protection offered to the user. As a matter of fact, the inflation causes side shrinkage of the bag, thereby diminishing the covered area by the bag. Moreover, being the inflation of the inflatable bag not controlled, there is the risk that the inflation may compress the user's body, possibly causing an injury.

At the same time, in case of an unwanted activation, the balloon shape may hinder the movements of the user leading, in the worst scenario, even to a loss of control of the motorcycle or bicycle.

The use of internal tethers to control the expansion of the inflatable bags is known. In particular, the tethers are designed to connect the upper and lower layers of the inflatable bag so as to prevent the latter from "ballooning".

In case the inflatable bag is manufactured by sewing together a lower panel and an upper panel along their perimetric portions, so as to obtain the so-called "sewed" airbag, the internal tethers can be formed by threads fixed to such opposite panels of the inflatable bag.

In case the inflatable bag is manufactured by means of a single weaving operation, using for example a Jacquard loom, so as to obtain the so-called "one piece woven" (OPW) airbag, the tethers can be formed inside the inflatable bag during the weaving. In this case the internal tethers are made of the same warp and weft threads forming the upper and lower layers of the inflatable bag.

Even if the use of internal tethers allows to control the final shape of the inflatable bags, such a solution presents some drawbacks.

First of all, the incorporation of internal tethers into the inflatable bag tends to be not only labor intensive, but also requires a significant amount of time.

In the case of the OPW airbags, while the manufacturing of airbags without tethers is easily producible and cheap, the manufacturing of airbags with internal tethers is more expensive and complex, since the Jacquard loom needs to be provided with specific tooling.

Conversely, in the case of the "sewed airbag", the fixing of the ends of the tether to the walls may lead to a perforation of the walls resulting in a leak of fluid during the inflation. To avoid this, the upper and lower layers are generally coated with an additional layer, for example a PU or silicon layer, so as to provide the bag with the necessary impermeability. In case of the "OPW airbag" the provision of the internal tethers does not affect the permeability of the airbag, even if, for reducing the permeability of the upper and lower layers, a coating may be applied to the outer surfaces of the airbag.

Obviously, the addition of such a coating in both cases increases the weight and the rigidity of the inflatable bags.

However, even if a coating layer is applied over the walls of the airbag, the points where the tethers are connected to the walls are critical, since they are subject to a high tensile force. Due to such a tension a partial detachment between wall and coating layer, similar to a delamination, may occur with the consequence that the bag may have a failure.

Moreover, even if the use of the internal tethers allows to control the expansion of the airbag, the latter in the inflated status becomes quite rigid so as not to be able to adapt itself to the user's body.

It is known to arrange internal zones having "zero height", namely not inflatable zones, in the inflatable chamber of the bags so as to make the latter more flexible once inflated. However, such "zero height" zones are created by means of internal joints connecting opposite walls. The internal joints may affect the integrity of the whole structure of the airbag, similarly to what it has been previously disclosed with reference to the internal tethers.

Furthermore, the internal joints are not able by themselves to cause the airbag to bend once the latter it is inflated. The airbag needs in any case to be arranged inside a specific housing created into the garment.

Examples of known wearable protection devices are disclosed in WO2011/148354A1 and in US2013/276213A1.

BRIEF SUMMARIES OF OBJECTS OF THE INVENTION

The main object of the present invention is therefore to provide a wearable protection device comprising an inflatable member configured to overcome or at least reduce the drawbacks above mentioned with reference to the known wearable airbag devices.

More specifically, the main object of the present invention is to provide a wearable protection device comprising an inflatable member, wherein the inflation of the inflatable member can be limited without the need of internal tethers.

A further object of the present invention is to provide a wearable protection device comprising an inflatable member able to better adapt to the anatomy of the user's body. Furthermore, an object of the present invention is to provide a wearable protection device comprising an inflatable member suitable for allowing airflow there through, thereby improving breathability and comfort of the wearable protection device.

Again, a further object of the present invention is to provide a wearable protection device comprising an inflatable member, wherein not only the final shape, but also the final volume of the inflatable member can be controlled during the inflation.

Finally, an object of the present invention is to provide a wearable protection device comprising an inflatable member which can be manufactured at competitive costs.

The above-mentioned objects, and other objects that will better appear in the following of the present description, are achieved by a wearable protection device according to claim 1.

BRIEF DESCRIPTIONS OF THE DRAWINGS

The advantages and the characteristic features of the invention will appear more clearly from the following description of a preferred, but not exclusive, embodiment of the wearable protection device which refers to the accompanying figures in which.

DETAILED DESCRIPTION OF EMBODIMENTS OF THE INVENTION

Figure 3:
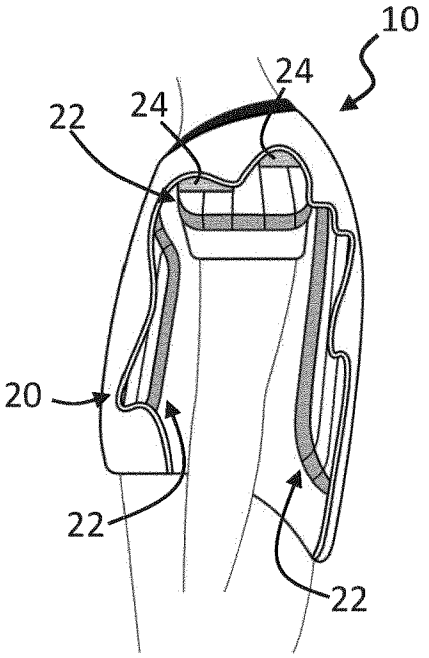
FIG. 3 shows, in schematic form, a partially sectioned side view of the wearable protection device of FIG. 1.
Figure 2:
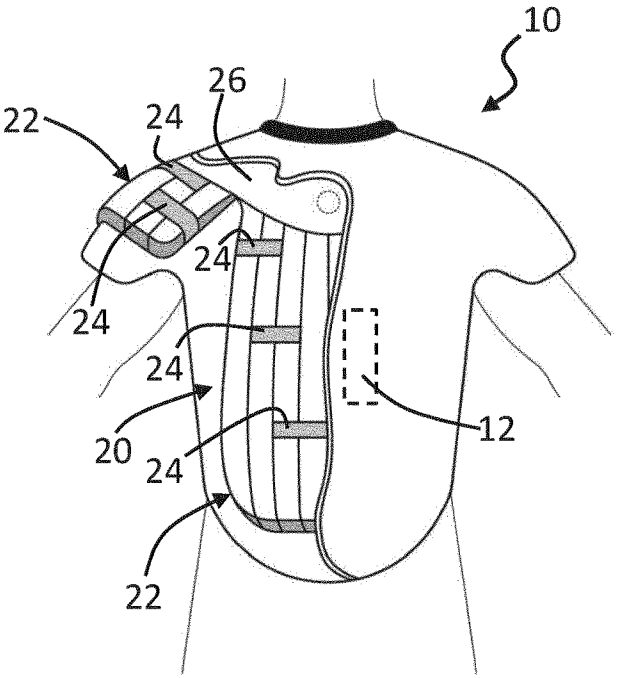
FIG. 2 shows, in schematic form, a partially sectioned back view of the wearable protection device of FIG. 1.
Figure 1:
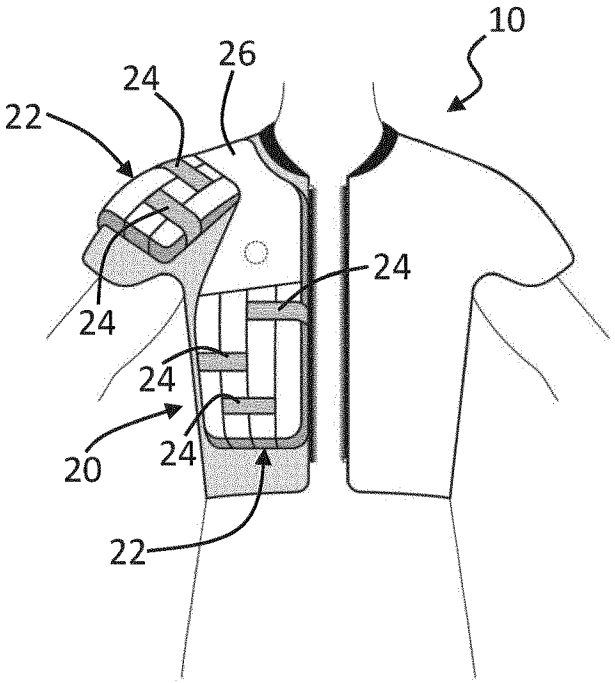
FIG. 1 shows, in schematic form, a partially sectioned front view of a wearable protection device, worn by a user, according to a first embodiment of the present invention.

With reference to FIGS. 1 to 3, an embodiment of a wearable protection device, according to the present invention is indicated, in its whole, by the reference 10.

The wearable protection device 10 can be a garment, like for example a jacket, a vest, pants or a suit, or alternatively can be an undergarment suitable for being used in combination with an outer protection garment.

In a further embodiment, the wearable protection device 10 can be a harness or a belt designed to be worn on top or under a further garment.

Figure 7:
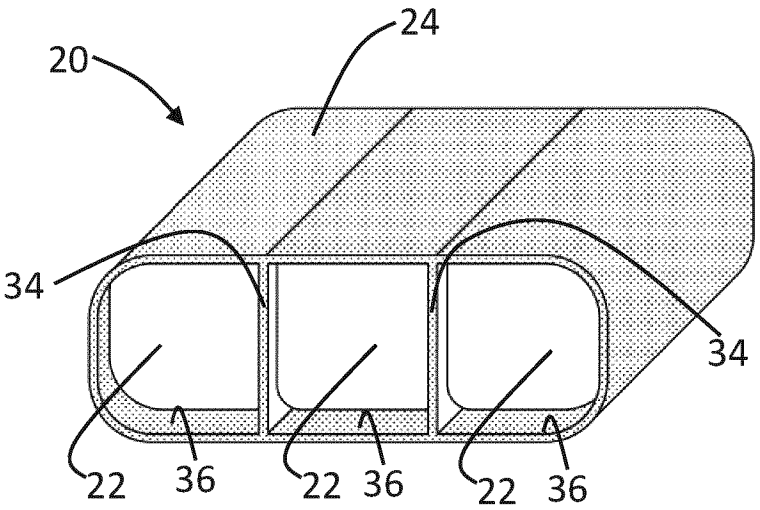
FIG. 7 shows, in schematic form, a perspective view of the inflatable member of FIG. 6 in the inflated status.
Figure 9:
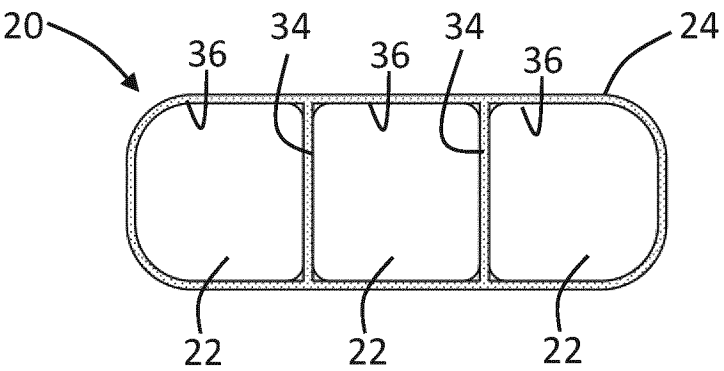
FIG. 9 shows, in a schematic form, a front view of the inflatable member of FIG. 7.
Figure 10:
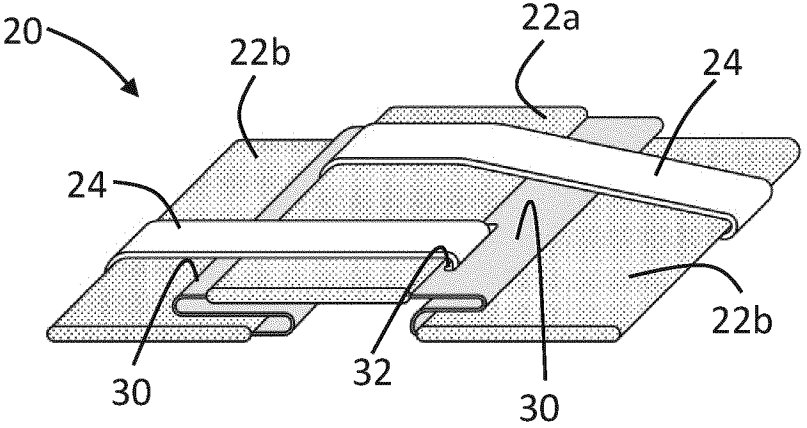
FIG. 10 shows, in schematic form, a perspective view of a further embodiment of an inflatable member, in the deflated status, suitable for being used in combination with the wearable protection device according to the invention.
Figure 11:
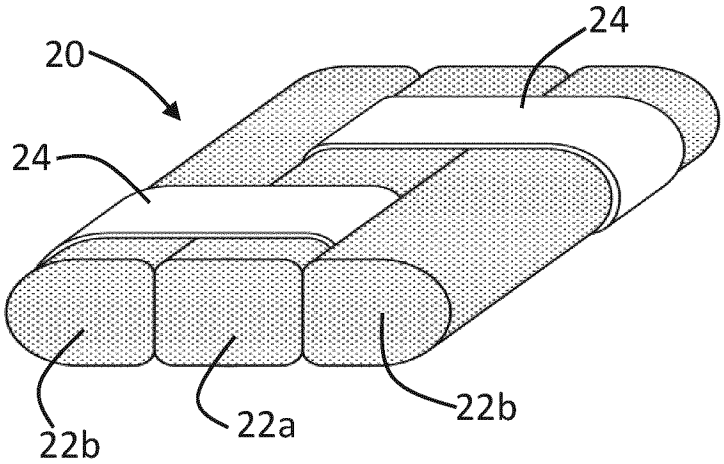
FIG. 11 shows, in schematic form, a perspective view of the inflatable member of FIG. 10 in the inflated status.
Figure 12:
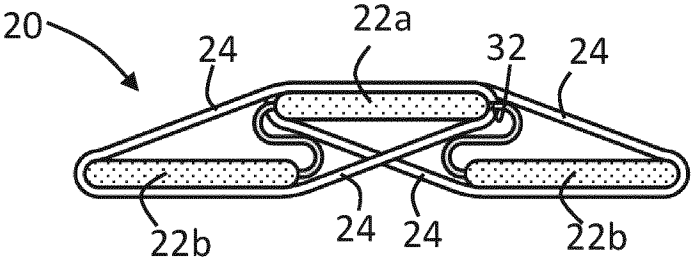
FIG. 12 shows, in schematic form, a front view of the inflatable member of FIG. 10.

The wearable protection device 10 comprises at least one inflatable member 20 suitable for moving between a rest configuration, wherein it is in a deflated status (see for example FIGS. 6 and 10), and an active configuration, wherein it is in an inflated status (see for example FIGS. 7 and 11).

The inflatable member 20 is designed to be inflated with a fluid, like for example air or gas, so as to expand in case of danger for protecting the wearer of the wearable protection device 10 against impacts, falls or slidings.

To carry out the inflation of the inflatable member 20, the wearable protective device 10 preferably comprises inflation means 12 which are in fluid communication with the inflatable member 20 (see FIG. 2). In particular, the inflation means 12 are provided with one or more outlets designed to be connected to corresponding inlets of the inflatable member 12. According to the embodiment of FIGS. 1-3, the inflatable member 20 is suitable for protecting the shoulders, the chest and the back of the wearer. However different arrangements of the inflatable member 20 are possible, in order to meet other specific needs. For example, the inflatable member 20 can be designed to also protect the arms, the hips and/or the legs of the wearer.

As shown in the attached figures, the inflatable member 20 comprises at least one elongated portion 22. As "elongated portion" there will be indicated a portion of the inflatable member 20 having a dimension, for example the length, significantly greater than the other dimension when the inflatable member is in a deflated status. As a matter of fact, in the rest configuration the inflatable member has a substantially two-dimensional structure.

Advantageously, the at least one elongated portion 22 has a substantially rectangular shape in the deflated status and it is able to assume a substantially cylindrical shape in the inflated status.

Preferably, the inflatable member 20 comprises a plurality of elongated portions 22. As "plurality of elongated portions" there will be indicated at least two elongated portions.

In particular, the elongated portions 22 of the inflatable member are designed to be positioned adjacent to one other. Advantageously, the elongated portions 22 once inflated form a cushioning body which consists in a plurality of substantially cylindrical cushioning elements in close proximity to one another.

As it will be clarified hereinafter, the number and the extension of the elongated portions 22 depend on the size and shape of the inflatable member 20.

Figure 5:
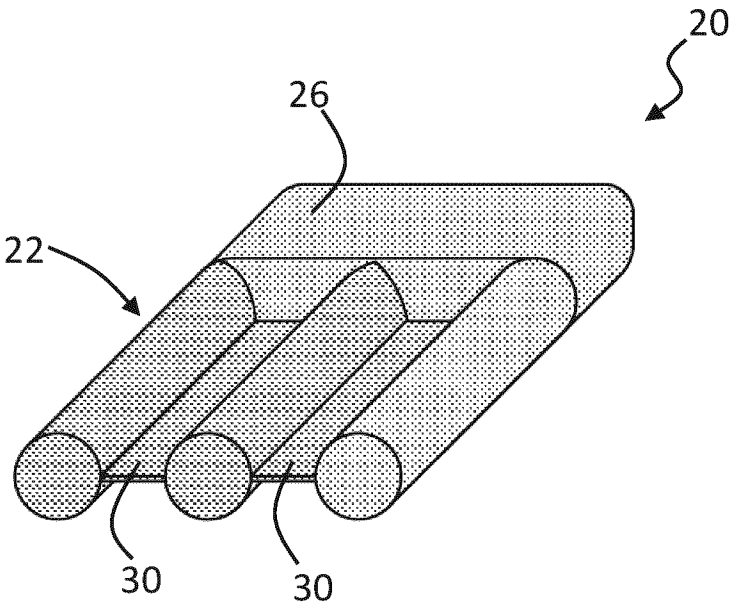
FIGS. 5 and 5A are figures similar to FIG. 4, but referring to different embodiments of the inflatable member.
Figure 4:
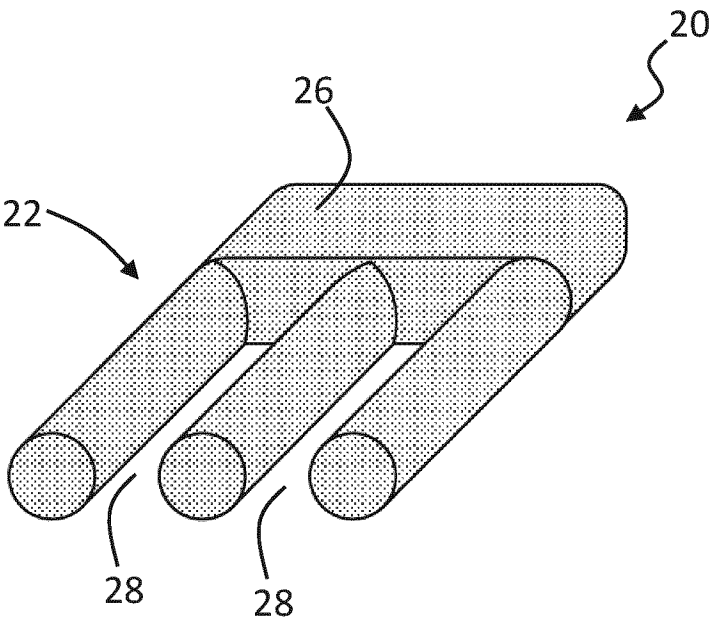
FIG. 4 show, in schematic form, a perspective view of an embodiment of an inflatable member suitable for being used in combination with the wearable protection device according to the invention.
Figure 5A:
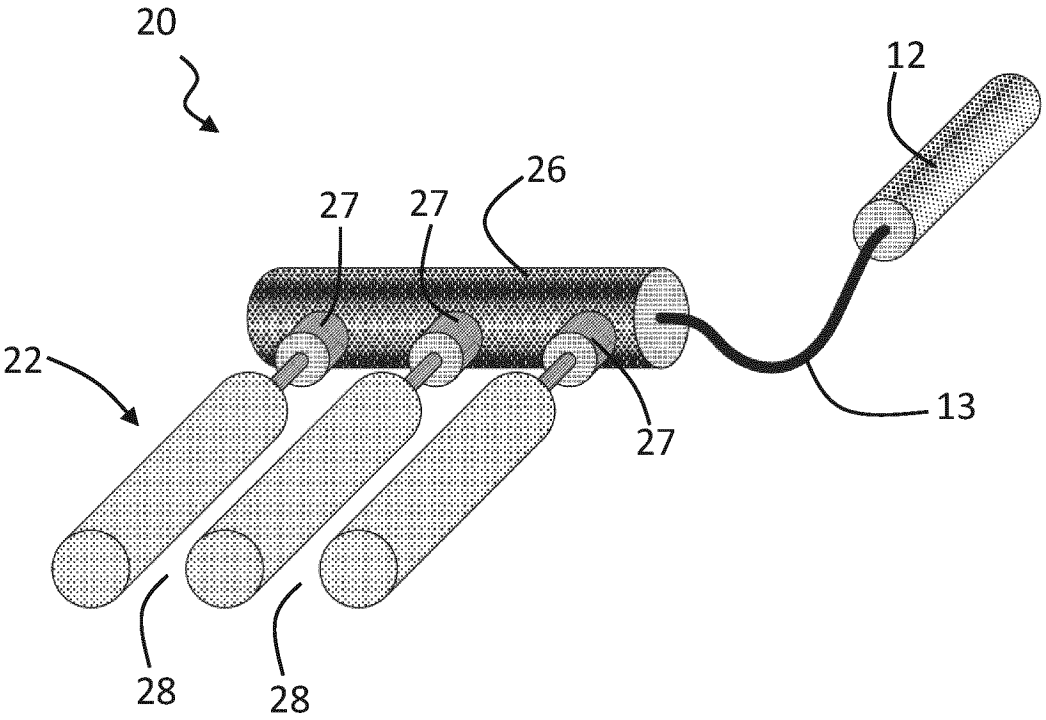

As schematically shown in FIGS. 4, 5 and 5A, the elongated portions 22 depart from a connecting body 26 with which they are in fluid communication. The connecting body 26 has the function to bring together the elongated portions 22 so as to facilitate the handling and the positioning of the elongated portions 22 inside the wearable protection device 10.

The connecting body 26 might be a connecting pipe. Preferably, the connecting pipe is made with a rigid material, for example it can be a metal pipe. The connecting pipe 26 can be connected to the inflation means 12 by means of a connecting duct 13 (see FIG. 5A).

In this embodiment, the connecting pipe 26 is preferably provided with one or more outlets 27 designed to be connected to corresponding inlets of the elongated portions 22.

Alternatively, the connecting body 26 can coincide with the inflation means 12. In this case, the inflation means 12 will be provided preferably with at least as many outlets as the number of the elongated portions 22.

In a further embodiment not shown in the enclosed figures, but easily conceivable by a skilled man in the art, the inflation means can comprise two or more canisters, each canister being designed to inflate a different elongated portion of the inflatable member.

Alternatively, the connecting body 26 can be a portion of the inflatable member 20 as shown in FIGS. 4 and 5.

In a first embodiment the connecting body 26 can be an inflatable portion of the inflatable member 20. Alternatively, the connecting body 26 might consist in a non-inflatable portion of the inflatable member 20, like a connecting duct connecting two different portions of the inflatable member, for example a duct connecting the front portion and the rear portion of the inflatable member.

If the connecting body 26 is an inflatable portion of the inflatable member 20, the connecting body 26 might be positioned around the neck of the wearer and can be superimposed over the top portion of the trunk, so that the various elongated portions 22 can extend, starting from the connecting body 26, over the shoulders, the back and the chest of the user (see FIGS. 1-3). However different arrangements of connecting body 26 and elongated portions 22 are possible in order to meet other specific needs.

Preferably, in case the connecting body 26 is a portion of the inflatable member 20, the inflation means 12 are connected to the connecting body 26, so that the inflation fluid is able to flow inside the connecting body 26 before reaching the elongated portions 22. In this way, a faster inflation of the inflatable member 20 can be obtained. At the same time, it is also possible to introduce the inflation fluid inside the inflatable member 20 with a high pressure. Also in this case the inflation means 12 can contain two or more canisters, each canister being designed for example to inflate a different portion of the inflatable member.

According to the invention, at least one part of the at least one elongated portion 22 of the inflatable member 20 is enwrapped by at least one constraint 24.

As it will be clarified in the following, the function of the constraint 24 is to limit the expansion of the at least one elongated portion 22 when the inflatable member 20 moves from the rest condition to the active configuration. Therefore, thanks to the provision of the constraint 24, it is possible to control the shape of the inflatable member 20 once it is inflated without being forced to provide it with internal tethers.

At the same time, thanks to the provision of the constraint 24, it is also possible to control the volume, and thus the internal pressure, of the inflatable member 20 once it is inflated.

In the meaning of the present invention, with the expression "to limit the expansion" is to be intended that a difference in volume between a free portion and a portion enwrapped by the constraint of the inflatable member can be detected when the internal pressure is above 0.2 bar.

As shown in the enclosed figures, advantageously the constraint 24 is designed to enwrap only the elongated portions 22 of the inflatable member 20, without interfering with the expansion of the connecting body 26. In other words, advantageously, the constraint 24 does not fully enwrap the whole inflatable member 20.

Preferably, parts of at least two adjacent elongated portions 22 of the inflatable member 20 are enwrapped by said at least one constraint 24.

The adjacent elongated portions 22 advantageously are positioned in close proximity, not necessarily in contact, to each other.

According to the embodiment of FIGS. 4 and 5A, wherein for sake of clarity the inflatable member 20 is shown in a partially inflated configuration and the constraint 24 is not shown, the elongated portions 22 are preferably aligned and transversally spaced apart to each other, so that air flow passages 28 can be defined between the portions 22.

Advantageously the airflow passages 28 allow to improve the breathability and the comfort of the wearable protection device 10.

Alternatively, as shown in FIG. 5, wherein similarly to FIGS. 4 and 5A the inflatable member 20 is shown in a partially inflated configuration and the constraint 24 is not shown, the elongated portions 22 are preferably aligned and transversally connected by means of a connecting layer 30 provided between facing surfaces of the portions 22.

The connecting layer 30 defines a non-inflatable zone of the inflatable member 20. Preferably, the connecting layer 30 can be made of the same material forming the inflatable member 20. Alternatively, the connecting layer 30 can be made with a breathable fabric so as to provide breathable zones between two adjacent elongated portions 22.

The function of the connecting layer 30 is to guarantee the alignment of the elongated portions 22 even in the inflated condition of the inflatable member 20.

As shown in FIGS. 1-3 and 10-11, the constraint 24 can consist of a strip disposed transversally to the elongated portion 22. Preferably the constraint 24 is a strip disposed transversally to at least two adjacent elongated portions 22 to be connected.

As shown in FIGS. 1-3, each elongated portion 22 can be connected to different elongated portions 22 by means of different constraint 24.

Advantageously, for example, a same elongated portion 22 can be connected to a first adjacent elongated portion by means of a first constraint 24 and to a second adjacent elongated portion by means of a second constraint 24.

At the same time, with reference for example to FIG. 1, the elongated portions 22 arranged above the shoulders or the back of the user can be enwrapped by first constraints 24 and the elongated portions 22 arranged above the chest can be enwrapped by second constraints 24, different than the first constraints.

If the constraint is a strip arranged transversely to the adjacent elongated portions to be connected, this strip can be made of fabric or polymeric material. Advantageously the strip 24 can be made of flexible material and, in some specific embodiment, it can also be provided with a limited elasticity.

Figure 6:
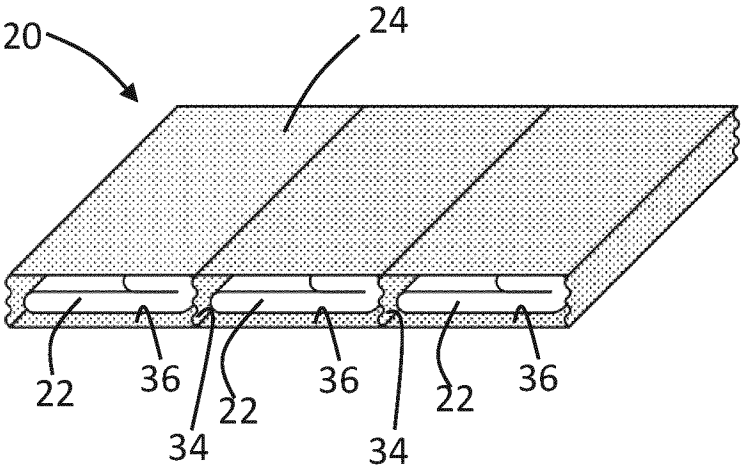
FIG. 6 shows, in schematic form, a perspective view of a further embodiment of an inflatable member, in the deflated status, suitable for being used in combination with the wearable protection device according to the invention.

Alternatively, as shown for example in FIGS. 6 and 7, the constraint 24 can consist of a casing acting as a partial cover for the adjacent elongated portions to be connected. Preferably, the casing 24 fully covers the elongated portions 22 to be connected.

Advantageously, the casing 24 can be made with a material having a controlled pliability in order to allow the elongated portions to better adapt to the body of the user, without impairing its retaining function.

Preferably, the casing 24 can be made with a breathable material, for example a mesh material or a breathable fabric.

Advantageously, in case it is provided with a limited flexibility, the casing 24 allows to also obtain, if needed, a planar configuration, namely a configuration having a thickness substantially uniform, of the elongated portions 22 when they are in the inflated condition. In particular, the provision of the casing 24 allows to set a specific thickness of the elongated portions 22 in the inflated condition, for example 5-6 cm. Such a configuration is particularly useful because, in order to provide a uniform protection to the user, it is not needed to place a further protection element, like a plate, a back protector or a chest protector, on top of the elongated portions 22.

As a matter of fact, the casing 24 is helpful in distributing the impact forces acting on the inflatable member 20 on a larger surface, by avoiding that the impact forces act locally and directly on the elongated portions 22.

By distributing the impact forces on a larger surface, for given impact force, the inflatable member, if provided with the casing 24, is thus able to sustain increased external pressure without needing to be combined with an additional rigid or semirigid protector.

At the same time, the casing 24 can also be used advantageously when the elongated portions 22 are placed below a further protection element (not shown in the enclosed figures). As a matter of fact, the inflation of the elongated portions 22, being planar and limited by the casing, does not interfere with the protection element.

At the same time, the provision of a flexible casing 24 advantageously permits the elongated portions 22 of the inflatable member to better adapt to the user's body when they are in the inflated status. As a matter of fact, the elongated portions 22 are allowed to also assume a bent configuration if needed.

Advantageously the strip configuration of the constraint 24 can be used to connect elongated portions 22 which are also connected by means of the connecting layer 30.

In this case, the connecting layer 30 is preferably provided with a slit 32 suitable for being engaged by the constraint 24 (see FIG. 10-13).

At the same time the strip configuration of the constraint 24 can also be used to connect together three elongated portions 22: a middle elongated portion 22*a* and two side adjacent elongated portions 22*b* (see FIGS. 10-13).

Such a configuration can be advantageously used when the area to be protected by the inflatable member 20 is greater.

As shown in FIGS. 10-13, the middle elongated portion 22*a* is connected to each of the side adjacent elongated portions 22*b* by means of a separate constraint 24.

Preferably, in this embodiment, in the rest configuration the middle portion 22*a* is aligned and partially superimposed over the side adjacent portions 22*b*. In this way, in case the connecting layer 30 is made with a breathable material, air flow passages are still provided between the middle portion 22*a* and the side adjacent portions 22*b* of the inflatable member 20, without affecting the protection offered to the user. As a matter of fact, thanks to the above-mentioned arrangement of the constraints 24, once inflated, the elongated portions can assume a configuration wherein the middle portions 22*a* are interposed and in contact with the side portions 22*b*.

Figure 13:
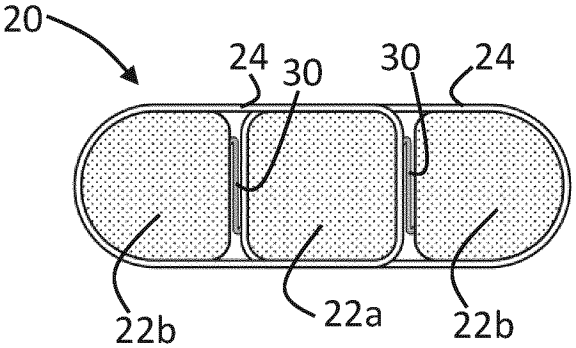
FIG. 13 shows, in a schematic form, a front view of the inflatable member of FIG. 11.

As shown in FIGS. 11 and 13, in the inflated condition of the elongated portions 22*a*, 22*b* the connecting layers 30 can be sandwiched between facing surfaces of the elongated portions 22*a*, 22*b*.

In this embodiment, the expansion of the elongated portions 22*a*, 22*b* is stopped when the volume defined by the constraint 24 is fully occupied.

As shown in FIGS. 10 and 11, in this embodiment the inflatable member 20 preferably comprises a plurality of constraints 24 positioned in a spaced-apart relation to each other. In this way, similarly to the casing configuration of the constraint 24, the expansion of the elongated portions can be limited and controlled along their entire length.

The provision of the constraints 24 allows the elongated portions 22, being the latter independent to each other, to better adapt to the user's body. For example, if the elongated portions 22 are disposed over a substantially planar surface, like for example the back of the user, the constraints 24 will be able to keep the portions 22, when they are inflated, in a substantially planar configuration. At the same time, if the elongated portions are disposed over a curved surface, for example over the shoulders or the sides of the user, the constraints 24 will be able to allow a bending of the elongated portions 22 so that the latter can adapt to the underlying surface.

Advantageously the casing configuration of the constraint 24 can also be used to connect elongated portions 22 which are spaced apart to each other.

In this case, see for example FIGS. 6-9, the casing 24 is provided with partition walls 34 designed to define inside the casing 24 internal chambers 36, each chamber 36 housing one of the elongated portions 22 connected by the casing 24.

Advantageously the provision of the partition walls 34 helps the elongated portions 22 to stay aligned both in rest configuration and active configuration. Moreover, the partition walls 34 advantageously limit the expansion of the casing 24, so as to guarantee that the latter controls the expansion of the elongated portions 22, once they are inflated (see FIGS. 7 and 9).

Figure 8:
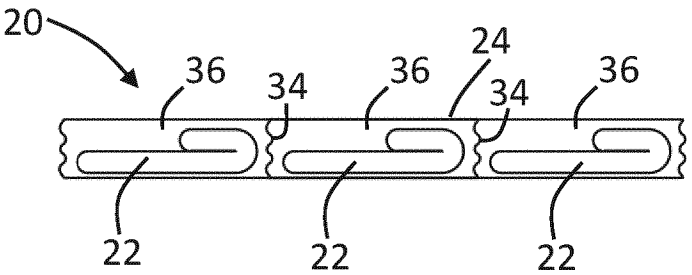
FIG. 8 shows, in schematic form, a front view of the inflatable member of FIG. 6.

As shown in FIGS. 6 and 8, the elongated portions 22 in the rest configuration can be arranged at least partially folded inside the internal chambers 36. In alternative embodiments, not shown in the figures, the elongated portions can be arranged at least partially rolled up inside the internal chambers 36.

In this way, in case the casing 24 is made with a breathable material, airflow passages are provided between the elongated portions 22 so as to improve the comfort offered by the wearable protection device 10.

At the same time, such an arrangement does not affect the protection, since the elongated portions 22 even if folded in the rest configuration, once they are inflated will fill the whole volume of the internal chambers 36.

At this point it is clear how the predefined objects may be achieved with the wearable protection device 10 according to the invention.

The expansion of the inflatable member 20 is controlled by means of the constraint 24, without the need of internal tethers inside the inflatable member 20.

Moreover, the inflatable member 20 thanks to the provision of the constraint 24 is able to better adapt to the user's body.

As a matter of fact, in case the elongated portions 22 of the inflatable member 20 are designed to protect a substantially planar portion of the user's body, like for example the back or the chest of the user's body, the constraint 24 permits that the portions 22 assume a substantially planar configuration also in the inflated status, so as to offer an improved protection to the user without affecting the comfort and reducing the risk that the user's body might be compressed during the inflation of the inflatable member 20.

Similarly, in case the elongated portions of the inflatable member are designed to be superimposed to a curved portion of the user's body, like for example the shoulders or the sides, the constraint 24 permits the elongated portions 22 to bend so as to better adapt to the user's body to protect. At the same time, the provision of elongated portions spaced apart to each other allow to create airflow passages through the inflatable member, so as to improve the comfort and the breathability of the wearable protection device without affecting the protection offered thereof.

Furthermore, the constraint 24 permits not only to control the final shape of the inflatable member, but also to limit the internal volume, and therefore to increase the internal pressure thereof.

Again, the constraint 24 in the form of the casing provided with internal partition walls is helpful in distributing on a larger surface the impact forces acting on the inflatable member 20, in particular on the elongated portions 22, so as to permit to sustain increased external pressure without needing to be combined with rigid or semirigid protections.

Moreover, the constraint 24, by acting only on the elongated portions without interfering with the connecting body of the inflatable member, does not affect the inflation time of the inflatable member.

Finally, both "sewed airbags" and "OPW airbags" can be used in combination with the constraint 24, without needing specific adjustments. The inflatable member 20 is thus manufactured in both cases at competitive costs, since it does not require to be provided with internal tethers or to be coated with additional layers to control its fluid retention.

With regard to the embodiments of the wearable protective device 10 described above, the person skilled in the art may, in order to satisfy specific requirements, make modifications to and/or replace elements described with equivalent elements, without thereby departing from the scope of protection of the accompanying claims.

The invention claimed is:

1. A wearable protection device comprising at least one inflatable member suitable for moving between a rest configuration in a deflated status and an active configuration in an inflated status, the at least one inflatable member comprising at least two elongated portions which depart from a connecting body;

the at least two elongated portions being designed to be positioned adjacent to one another and being in fluid communication with the connecting body;

characterized in that parts of said at least two elongated portions are enwrapped by at least one constraint which is designed to limit the expansion of said at least two elongated portions when the inflatable member moves in the active configuration;

wherein said at least one constraint consists of a casing acting as a partial cover for said at least two elongated portions, the casing being provided with partition walls configured to define inside the casing internal chambers, each internal chamber housing one of said at least two elongated portions.

2. The wearable protection device according to claim 1, characterized in that said at least two elongated portions are aligned and transversally spaced apart to each other so that air flow passages are defined between said at least two adjacent elongated portions.

3. A wearable protection device comprising at least one inflatable member suitable for moving between a rest configuration in a deflated status and an active configuration in an inflated status, the at least one inflatable member comprising at least two elongated portions which depart from a connecting body;

the at least two elongated portions being designed to be positioned adjacent to one another and being in fluid communication with the connecting body;

characterized in that parts of said at least two elongated portions are enwrapped by at least one constraint which is designed to limit the expansion of said at least two elongated portions when the inflatable member moves in the active configuration;

wherein said parts of said at least two adjacent elongated portions, enwrapped by the at least one constraint, are aligned and transversally connected by means of a connecting layer provided between facing surfaces of said at least two adjacent elongated portions, the connecting layer defining a non-inflatable zone of the inflatable member and said connecting layer being provided with a slit suitable for being engaged by said at least one constraint.

4. The wearable protection device according to claim 3, characterized in that said at least one constraint consists of a strip disposed transversally to said at least one elongated portion.

5. The wearable protection device according to claim 3, characterized in that the at least one inflatable member comprises at least three adjacent elongated portions formed by a middle elongated portion and two side adjacent elongated portions;

the middle elongated portion being connected to each of said two side adjacent elongated portions by means of a separate constraint.

6. The wearable protection device according to claim 5, characterized in that the middle elongated portion in the rest configuration is aligned and at least partially superimposed over the side adjacent elongated portions.

7. The wearable protection device according to claim 1, characterized in that said at least two adjacent elongated portions in the rest configuration are arranged at least partially folded or rolled up inside said internal chambers.

8. The wearable protection device according to claim 1, characterized in that the connecting body is an inflatable portion of the inflatable member.

9. The wearable protection device according to claim 1, characterized in that the connecting body is a non-inflatable portion of the inflatable member.

10. The wearable protection device according to claim 1, characterized in that the connecting body is a connecting pipe made preferably with a rigid material.

11. The wearable protection device according to claim 10, characterized by comprising inflation means in fluid communication with the inflatable member;

the connecting body coinciding with said inflation means.

12. The wearable protection device according to claim 1, further comprising inflation means in fluid communication with the inflatable member and said at least two elongated portions;

the inflation means comprising two or more canisters wherein each canister is suitable for inflating a different elongated portion of the inflatable member.

13. The wearable protection device according to claim 1, characterized in that said at least one inflatable member comprises a plurality of elongated portions designed to be positioned adjacent to one other;

said plurality of elongated portions, once inflated, forming a cushioning body which consists in a plurality of substantially cylindrical cushioning elements in close proximity to one another.

14. The wearable protection device according to claim 3, characterized in that the connecting body is an inflatable portion of the inflatable member.

15. The wearable protection device according to claim 3, characterized in that the connecting body is a non-inflatable portion of the inflatable member.

16. The wearable protection device according to claim 3, characterized in that the connecting body is a connecting pipe made preferably with a rigid material.

17. The wearable protection device according to claim 16, characterized by comprising inflation means in fluid communication with the inflatable member;

the connecting body coinciding with said inflation means.

18. The wearable protection device according to claim 3, further comprising inflation means in fluid communication with the inflatable member and said at least two elongated portions; the inflation means comprising two or more canisters wherein each canister is suitable for inflating a different elongated portion of the inflatable member.

19. The wearable protection device according to claim 3, characterized in that said at least one inflatable member comprises a plurality of elongated portions designed to be positioned adjacent to one other;

said plurality of elongated portions, once inflated, forming a cushioning body which consists in a plurality of substantially cylindrical cushioning elements in close proximity to one another.

20. The wearable protection device according to claim 1, wherein the casing is made of breathable material.

21. The wearable protection device according to claim 3, wherein the connecting layer is made of breathable.

* * * * *